US005775433A

United States Patent [19]

Hammett et al.

[11] Patent Number: 5,775,433

[45] Date of Patent: Jul. 7, 1998

[54] COILED TUBING PULLING TOOL

[75] Inventors: Robert C. Hammett, Garland; James Dan Vick, Jr., Dallas, both of Tex.

[73] Assignee: Halliburton Company, Duncan, Okla.

[21] Appl. No.: 626,871

[22] Filed: Apr. 3, 1996

[51] Int. Cl.[6] ..... E21B 31/20

[52] U.S. Cl. ..... 166/98; 166/381; 294/86.17; 294/86.25

[58] Field of Search ..... 166/98, 301, 381; 294/86.25, 86.17

[56] References Cited

U.S. PATENT DOCUMENTS

| | | | |
|---|---|---|---|
| 4,368,911 | 1/1983 | Pringle | 166/98 |
| 4,767,145 | 8/1988 | Bullard | 294/86.25 |
| 4,986,362 | 1/1991 | Pleasants | 166/382 |
| 5,040,598 | 8/1991 | Pleasants | 166/98 |
| 5,145,228 | 9/1992 | Boyle | 294/86.25 |
| 5,180,012 | 1/1993 | Crawford | 166/381 |
| 5,197,773 | 3/1993 | Vick, Jr. | 294/86.25 |
| 5,242,201 | 9/1993 | Beeman | 294/86.17 |

*Primary Examiner*—Hoang C. Dang
*Attorney, Agent, or Firm*—Stephen R. Christian; C. Clark Dougherty, Jr.

[57] ABSTRACT

An improved coiled tubing pulling tool and methods of using the pulling tool for pulling a well tool from a well bore, relocating a well tool in the well bore and performing other similar operations. The pulling tool is basically comprised of an elongated inner mandrel having an axial fluid flow passageway therethrough adapted to be connected to a length of coiled tubing, a latching mandrel connected at the end of the inner mandrel having a fluid flow passageway therethrough and having a fishing nose thereon, a tubular piston member slidably extending over the inner mandrel which is movable by fluid pressure in a direction away from the fishing nose, a first spring disposed between the inner mandrel and the piston member for urging the piston member in a direction towards the fishing nose, a latching device disposed on the latching mandrel connected to the piston member before latching the pulling tool to a fishing neck of a well tool and a releasing system for unlatching the pulling tool when sufficient fluid pressure is applied to the pulling tool to overcome the spring and move the piston member away from the fishing nose.

20 Claims, 1 Drawing Sheet

COILED TUBING PULLING TOOL

BACKGROUND OF THE INVENTION

1. Field of the Invention

The present invention relates to a pulling tool which can be used with coiled tubing and methods of using the pulling tool in a well bore.

2. Description of the Prior Art

Well tools are often anchored in well bores to accomplish completion, operating and/or remedial objectives. For example, temporary packers are often set in the well bores of oil and gas wells during the completion and/or operating phases of the wells. In addition, various operating tools such as flow controllers and the like are often releasably anchored in the well bores of operating wells. When it is desired to pull such a well tool out of a well bore, a pulling tool has heretofore been used which includes a fishing nose and latching assembly for latching to a fishing neck on the well tool whereby the well tool can be pulled from the well bore.

U.S. Pat. No. 5,040,598 issued to Charles W. Pleasants on Aug. 20, 1991 discloses a heretofore used pulling tool and methods of using the tool. The pulling tool is attached to coiled tubing and includes a fishing nose having a latching assembly disposed thereon for latching to the fishing neck of a well tool. The latching assembly of the pulling tool automatically latches to the fishing neck of the well tool when the fishing nose of the pulling tool engages the fishing neck. Once latching of the pulling tool to the well tool has taken place, the coiled tubing and the pulling tool are moved upwardly to pull the well tool out of the well bore.

In the event the well tool to which the pulling tool of U.S. Pat. No. 5,040,598 is attached is stuck or jammed whereby it can not be pulled from the well bore, a ball is dropped through the coiled tubing into the pulling tool where it lands on a seat and closes off the flow of fluid through the pulling tool. Fluid pressure builds up in the pulling tool which moves a piston member connected to the latching assembly causing the latching assembly to release and the pulling tool to disengage from the well tool. When the piston member is caused to move by fluid pressure, pins holding the piston member in place are sheared and a snap ring enters a complimentary groove which maintains the piston member in a fixed position.

Thus, while the pulling tool of U.S. Pat. No. 5,040,598 has been used successfully, if it is released from a well tool in the well bore, it cannot be relatched to the well tool without first being removed from the well bore to reset the piston member, replace the sheared pins, etc. Accordingly, there is a need for a coiled tubing pulling tool and methods of using the tool whereby it can be latched to and released from a well tool in a well bore as many times as is necessary to remove or relocate the well tool without the need for removing the pulling tool from the well bore.

SUMMARY OF THE INVENTION

The present invention provides an improved coiled tubing pulling tool and methods of using the tool which meet the needs described above and overcome the shortcomings of the prior art. The improved pulling tool of this invention can be latched to and released from a well tool in a well bore as many times as desired or necessary without being removed from the well bore.

The pulling tool is basically comprised of an elongated inner mandrel having an axial fluid flow passageway therethrough adapted to be connected at one end to a length of coiled tubing. A latching mandrel is connected at the other end of the inner mandrel having a fluid flow passageway communicating with the fluid flow passageway of the inner mandrel. The latching mandrel includes a fishing nose sized to engage a fishing neck of a well tool. At least one fluid jet forming passage extends from the fluid flow passageway of the latching mandrel through the fishing nose thereof. A tubular piston member is slidably disposed over the inner mandrel whereby increased fluid pressure applied to the pulling tool urges the piston member in a direction away from the fishing nose on the latching mandrel. A compression spring is disposed between the inner mandrel and the piston member for urging the piston member in a direction towards the fishing nose. Latching means are disposed on the latching mandrel for latching the pulling tool to the fishing neck of the well tool when the fishing neck is engaged by the fishing nose. Releasing means are also provided for unlatching the pulling tool from the fishing neck of the well tool when sufficient increased fluid pressure is exerted in the tool to overcome the compression spring and move the piston member away from the fishing nose.

Methods of using the improved coiled tubing pulling tool in a well bore for removing a well tool from the well bore, relocating a well tool in the well bore and performing other similar downhole operations are also provided.

It is, therefore, a general object of the present invention to provide an improved coiled tubing pulling tool and methods of using the tool.

A further object of the present invention is the provision of an improved coiled tubing pulling tool and methods of using the tool whereby the pulling tool can be latched to and unlatched from the fishing neck of a well tool in a well bore as many times as is required without removing the coiled tubing and pulling tool from the well bore.

Other and further objects, features and advantages of the present invention will be readily apparent to those skilled in the art upon a reading of the description of preferred embodiments which follows when taken in conjunction with the accompanying drawings.

Figure 1:
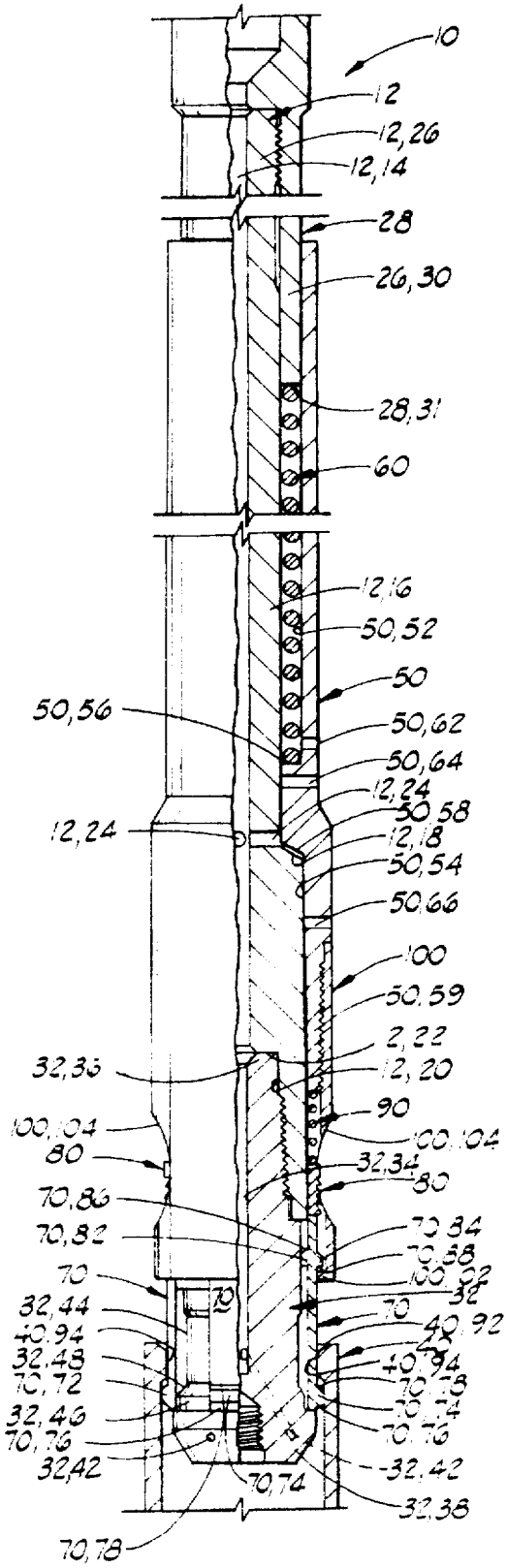
FIG. 1 is a partially cross-sectional side view of the improved pulling tool of this invention shown latched to a fishing neck of a well tool.

In the drawings, major components of the pulling tool are generally designated by numerals. The parts and portions of the major components which are referred to are also designated by numerals, but those numerals are preceded by the general designation of the component involved.

DESCRIPTION OF PREFERRED EMBODIMENTS

As mentioned above, coiled tubing pulling tools and methods of using such pulling tools for removing well tools from well bores have been developed and used heretofore. Such a pulling tool is disclosed in U.S. Pat. No. 5,040,598 issued to Pleasants on Aug. 20, 1991 and assigned to the assignee of this present invention which is incorporated herein by reference. While the pulling tool of U.S. Pat. No. 5,040,598 has been utilized successfully, it suffers from the disadvantage that once it has engaged the fishing neck of a well tool in a well bore and latched thereto if it becomes necessary to unlatch and disengage the pulling tool from the well tool, the pulling tool must then be removed from the well bore and reset before it can again latch to the well tool. That is, in order to unlatch the pulling tool from a well tool fishing neck, a ball is dropped which seats in the pulling tool and causes the fluid pressure applied to the pulling tool to increase. When the pressure reaches a level high enough, shear pins in the tool holding a piston member in place are sheared and the piston member is moved upwardly causing the latching assembly of the pulling tool to be moved to the unlatched position. When the piston reaches its uppermost position, a snap ring in the tool engages a complimentary groove thereby holding the piston in that position. Before the pulling tool can be relatched to a fishing neck, it must be removed from the well bore and reset, i.e., the ball must be removed from the tool, the piston member must be returned to its original position and the shear pins must be replaced.

The improved coiled tubing pulling tool of the present invention overcomes the shortcomings of the pulling tool of U.S. Pat. No. 5,040,598 and other prior art pulling tools by having the capability of latching to and unlatching from a fishing neck of a well tool in a well bore as many times as are necessary to perform a desired operation in the well bore without the necessity of removing the pulling tool from the well bore.

Referring now to the drawings, the improved pulling tool of the present invention is illustrated and generally designated by the numeral 10. The pulling tool 10 is comprised of an elongated hollow inner mandrel 12 having a fluid flow passageway 14 therethrough. The inner mandrel 12 includes a reduced diameter portion 16 defining an outer shoulder 18 and a counterbore 20 defining an inner shoulder 22. The inner mandrel also includes at least one, preferably four, lateral fluid passages 24 extending from the axial fluid flow passageway 14 to the outer shoulder 18.

The end 26 of the inner mandrel 12 is connected to a crossover 28 which is in turn connected to a length of coiled tubing (not shown) in a conventional manner. That is, an internally threaded cylindrical part 30 of the crossover 28 is threadedly connected to external threads on the end 26 of the inner mandrel 12 and extends over an additional portion of the inner mandrel 12 adjacent the end 26 thereof.

A latching mandrel 32 is threadedly connected to the inner mandrel 12 within the counterbore 20 thereof. The latching mandrel 32 includes a fluid flow passageway 34 communicating with the fluid flow passageway 14 of the inner mandrel 12. The end 36 of the latching mandrel 32 within the counterbore 20 abuts the inner shoulder 22 of the inner mandrel 12. The opposite end of the latching mandrel 32 includes a beveled fishing nose 38 for facilitating its engagement with a fishing neck 40 of a well tool (not shown). A plurality of, preferably four, fluid jet forming passages 42 are formed in the latching mandrel 32 extending from the fluid flow passageway 34 thereof through the fishing nose 38. The latching mandrel 32 further includes a reduced diameter portion 44 connected to an increased diameter portion 46 by a ramp portion 48. The increased diameter portion 46 is positioned adjacent the fishing nose 38 of the latching mandrel 32.

A tubular piston member 50 is slidably disposed over the inner mandrel and over the end portion 30 of the crossover 28. The piston member 50 has two internal bores 52 and 54 which define two spaced internal shoulders 56 and 58, respectively. The internal shoulder 58 of the piston member 50 is complimentary to the outer shoulder 18 of the inner mandrel 12. As mentioned, the lateral passages 24 of the inner mandrel 12 communicate with the outer shoulder 18 thereof and also with the space between the outer shoulder 18 and the internal shoulder 58 of the piston member 50. As will be described further hereinbelow, when fluid pressure is exerted between the shoulders 18 and 58 by way of the lateral fluid passages 24 and the axial fluid flow passageway 14 of the inner mandrel 12, the piston member 50 is urged in a direction away from the fishing nose 38 of the latching mandrel 32.

A compression spring 60 is disposed in the internal bore 52 between the internal shoulder 56 of the piston member 50 and the end 31 of the portion 30 of the crossover 28. The spring 60 exerts a force between the inner mandrel 12 and the piston member 50 which urges the piston member 50 in a direction towards the fishing nose 38 of the latching mandrel 32.

The piston member 50 further includes at least one, preferably four, lateral ports 62 extending from the internal bore 52 of the piston member 50 to the exterior thereof. The ports 62 function to drain the space between the inner mandrel 12 and the internal bore 52 of the piston member 50 containing the spring 60. In addition, the piston member 50 includes at least one, preferably four, lateral passages 64 on one side of the internal shoulder 58 thereof and at least one, preferably four, lateral passages 66 on the opposite side of the internal shoulder 58. The passages 64 and 66 function to drain fluid which leaks through the adjacent surfaces between the inner mandrel 12 and the piston member 50 from the space between the inner shoulder 18 of the inner mandrel 12 and the internal shoulder 58 of the piston member 50.

In the pulling tool 10 illustrated in the drawings, the adjacent surfaces of the inner mandrel 12 and piston member 50 between the drain ports 64 and 66 are of a close fit, but do not include O-ring or the equivalent seals. This arrangement allows some pressurized fluid communicated to the shoulders 18 and 58 by way of the lateral ports 24 of the inner mandrel 12 to leak between the adjacent surfaces of the inner mandrel 12 and the piston member 50 and exit the tool 10 by way of the passages 64 and 66. Thus, the pulling tool 10 avoids the expense of installing and maintaining seals therein, but such seals can be included in the tool 10 in lieu of the ports 64 and 66 if desired.

The pulling tool 10 includes a latching assembly for automatically latching the latching mandrel 32 of the pulling tool 10 to the fishing neck 40 of a well tool when the fishing nose 38 of the pulling tool 10 engages the fishing neck 40, and for selectively unlatching the pulling tool 10 from the fishing neck 40 so that it can be released from the fishing neck 40 when desired. The portion of the latching assembly which provides the capability of latching the pulling tool 10 to the fishing neck 40 is comprised of a plurality of, preferably four, latching members 70 which are spaced around the outer surface of the latching mandrel 32. The latching members 70 are slidably positioned on the latching mandrel 32 and extend in a direction parallel to the axis of the pulling tool 10. Each of the latching members 70 has an enlarged end portion 72 which normally engages the increased diameter portion 46 of the latching mandrel 32 adjacent the fishing nose 38 thereof. The enlarged end portions 72 of the latching member 70 project radially outwardly and have an outer flat arcuate surface 74 connected by arcuate ramp portions 76 and 78. The ends of the elongated retaining members 70 opposite the enlarged end portions 72 are connected to a retaining ring 80 which extends around the outer surface of the inner mandrel 12. Each of the latching members 70 also includes an enlarged inner portion 82 and an enlarged outer portion 84. The enlarged inner portion 82 includes a ramp portion 86 and the enlarged outer portion 84 forms an external shoulder 88. A compression spring 90 is disposed between the piston member 50 and the retaining ring 80 which urges the retaining ring 80 and the latching members 70 attached thereto in a direction towards the fishing nose 38 of the latching mandrel 32.

As will be further described hereinbelow, when the fishing nose 38 of the latching mandrel 32 engages the fishing neck 40 of a well tool (not shown) and moves into the fishing neck 40, the ramp portions 76 of the enlarged end portions 72 of the latching members 70 first engage complimentary ramp portions 92 within the fishing neck 40, and the latching members 70 and retaining ring 80 are pushed against the spring 90. The spring 90 is compressed which allows the retaining members 70 to be moved away from the fishing nose 38 of the latching mandrel 32 whereby the enlarged end portions 72 of the latching members 70 are moved from the increased radius portion 46 of the latching mandrel 32 down the ramp portion 48 and onto the reduced radius portion 44 to the position illustrated in FIG. 2. This allows the enlarged end portions 72 of the latching members 70 to move past the enlarged inwardly extending complimentary portion 94 of the fishing neck 40 to within the fishing neck 40 as shown in FIG. 1. Once the enlarged end portions 72 of the latching members 70 pass the enlarged inwardly extending portion 94 of the fishing neck 40, the spring 90 moves the retaining ring 80 and the latching members 70 in the opposite direction whereby they return to the position illustrated in FIG. 1.

The portion of the latching assembly which provides the capability of selectively unlatching the pulling tool 10 from the fishing neck 40 whereby it can be disengaged therefrom is comprised of the piston member 50, the spring 60 and a housing 100 which is threadedly connected to the end portion 59 of the piston member 50. The housing 100 covers the spring 90 and the outwardly extending shoulders 88 of the latching members 70. The end of the housing 100 includes an inwardly extending flange portion 102 for engaging the outwardly extending shoulders 88 of the latching members 70. When it is desired to unlatch the pulling tool 10 and disengage it from the fishing neck 40, the flow rate of the fluid flowing through the pulling tool 10 is increased whereby increased fluid pressure is applied between the outer shoulder 18 of the inner mandrel 12 and the internal shoulder 58 of the piston member 50. When the fluid pressure reaches a level sufficient to overcome the force exerted by the spring 60 and to compress the spring 60, the piston member 50 moves in a direction away from the fishing nose 38 of the latching mandrel 32 which moves the housing 100 and the latching members 70 whereby the enlarged end portions 72 of the latching members 70 are moved to their inward unlatched position illustrated in FIG. 2. This releases the pulling tool 10 whereby it can be disengaged from the fishing neck 40.

The housing member 100 includes a pair of opposite windows 104 formed therein for providing access to the retaining ring 80 so that the retaining ring 80 can be manually manipulated to release the fishing neck of a well tool from the pulling tool 10 on the surface.

Figure 2:
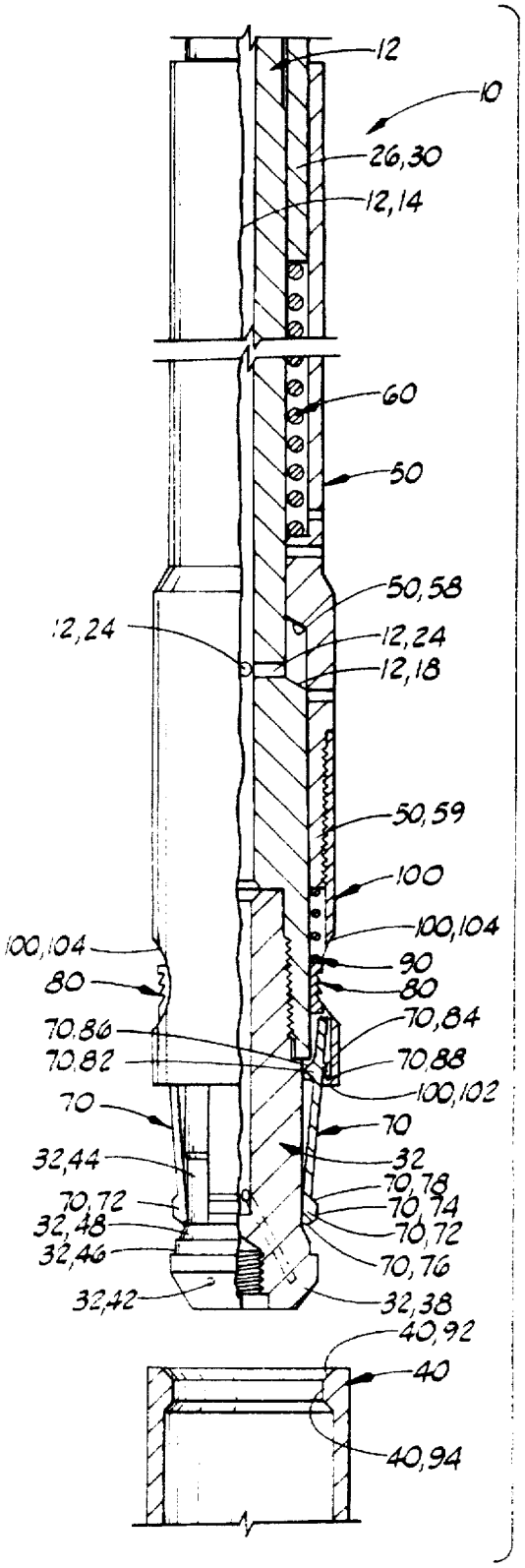
FIG. 2 is a cross-sectional side view of the pulling tool of FIG. 1 shown in the unlatched position and disengaged from the fishing neck.

In operation of the pulling tool 10, it is connected to a length of coiled tubing and it and the tubing are inserted in a well bore. The pulling tool 10 and tubing are lowered in the well bore to the location of a well tool having a fishing neck 40 thereon anchored in the well bore. While the pulling tool 10 and tubing are being lowered in the well bore and particularly when the pulling tool 10 reaches the vicinity of the well tool anchored in the well bore, a fluid such as salt water or other compatible fluid is pumped through the coiled tubing and through the pulling tool 10 into the well bore. The fluid is jetted out of the fishing nose 38 of the pulling tool 10 by way of the passages 42 therein whereby debris is cleared away from the pulling tool 10 as it is lowered and away from the fishing neck 40 of the well tool as the pulling tool 10 approaches and engages the fishing neck 40. As mentioned above, when the fishing neck 40 of the well tool is engaged by the fishing nose 38 of the pulling tool 10, the enlarged end portions 72 of the latching members 70 first engage the complimentary enlarged end portion 94 of the well tool fishing neck 40. As the pulling tool 10 is moved into the fishing neck 40, the enlarged end portions 72 of the latching members 70 are moved by contact with the complimentary enlarged portion 94 of the fishing neck 40 from a first outward fishing neck engaging position whereby the latching members 70 are supported on the surface 46 of the latching mandrel 32 to a second inward non-engaging position whereby the latching members 70 are supported on the surface 44 of the latching mandrel 32 as shown in FIG. 2. Once the enlarged end portions 72 of the latching members 70 are moved past the complimentary enlarged portion 94 of the fishing neck 40, the enlarged end portions 72 of the latching members 70 are moved back to the first outward engaging position whereby the latching members are resting on the surface 46 of the latching mandrel 32 as shown in FIG. 1.

When it is desirable to release the latching assembly of the pulling tool 10 from the fishing neck 40 and disengage the pulling tool 10 from the fishing neck 40, the flow rate of the fluid pumped through the coiled tubing and the pulling tool 10 are increased to a level whereby the fluid pressure applied to the pulling tool 10 and exerted by way of the fluid flow passageway 14 and lateral passages 24 of the inner mandrel 12 between the outer shoulder 18 of the inner mandrel 12 and the inner shoulder 58 of the piston member 50 causes the piston member 50 to compress the spring 60 and moves the piston member 50 away from the fishing nose 38 of the latching mandrel 32. The movement of the piston member 50 and the housing 100 attached thereto causes the latching members 70 to also be moved to the second inward non-engaging position described above which releases the enlarged end portions 72 of the latching members 70 from latching engagement with the complimentary enlarged end portion 94 of the fishing neck 40. With the latching members 70 in the second inward non-engaging position, the pulling tool 10 is withdrawn from the fishing neck 40 as shown in FIG. 2.

As will now be understood by those skilled in the art, the pulling tool 10 can be latched to the fishing neck of a well tool and released therefrom as desired without removing the pulling tool 10 from the well bore to reset the piston member, etc. Thus, the pulling tool 10 can be engaged with or released from the fishing neck of a well tool in a well bore as many times as is necessary to perform a particular operation in the well bore.

The improved methods of the present invention for latching to the fishing neck of a well tool in a well bore and releasing from the well tool to perform a desired operation in the well bore are basically comprised of the following steps. A pulling tool 10 of the present invention having a fishing nose 38 and a latching assembly including latching members 70 of sizes and types corresponding to the fishing neck 40 of the well tool is connected to a length of coiled tubing. As described above, the pulling tool 10 has a fluid flow passageway therethrough and is capable of latching to the well tool each time the fishing nose 38 thereof is engaged with the fishing neck 40 of the well tool and releasing from the well tool each time increased fluid pressure is applied to the pulling tool by way of the coiled tubing. The pulling tool 10 and coiled tubing are lowered in the well bore while pumping a fluid through the coiled tubing and through the pulling tool 10 into the well bore. The fishing nose 38 of the pulling tool 10 is engaged with the fishing neck 40 of the well tool in the well bore whereby the latching assembly of the pulling tool 10 latches to the fishing neck 40 as described above. The flow rate of the fluid pumped through the coiled tubing and the pulling tool 10 is increased to a level whereby the fluid pressure applied to the pulling tool 10 releases the latching assembly as described above and allows the fishing nose 38 of the pulling tool 10 to be disengaged from the fishing neck 40 of the well tool. The steps of engaging the fishing nose 38 of the pulling tool 10 with the fishing neck 40 of the well tool whereby the pulling tool 10 latches to the fishing neck 40 and increasing the flow rate of the fluid pumped through the coiled tubing and the pulling tool 10 to a level whereby the pulling tool 10 is released and can be disengaged from the fishing neck 40 of the well tool are repeated as is necessary to perform a desired operation.

As mentioned, the pulling tool of this invention can be utilized to pull a well tool having a fishing neck anchored in a well bore out of the well bore, to relocate a well tool having a fishing neck in a well bore, to anchor a well tool in a well bore and to perform other down hole operations in well bores where latching to the fishing neck of a well tool, releasing from the fishing neck of a well tool or both are required.

Thus, the present invention is well adapted to carry out the objects and advantages mentioned as well as those which are inherent therein. While numerous changes may be made by those skilled in the art, such changes are encompassed within the spirit of this invention as defined by the appended claims.

What is claimed is:

1. An improved coiled tubing pulling tool for latching to a well tool having a fishing neck thereon comprising:

an elongated inner mandrel having an axial fluid flow passageway therethrough, said inner mandrel being adapted to be connected at one end to a crossover attached to a length of coiled tubing, said inner mandrel including an outer shoulder formed thereon and having a lateral fluid passage extending from said axial fluid flow passageway to said outer shoulder;

a latching mandrel connected at the end of said inner mandrel opposite from said coiled tubing having a fluid flow passageway communicating with said fluid flow passageway of said inner mandrel, having a fishing nose thereon sized to engage said fishing neck on said well tool and having at least one fluid jet forming passage extending from said fluid flow passageway through said fishing nose;

a tubular piston member slidably extending over said inner mandrel and a portion of the crossover, said piston member having an inner shoulder formed therein which is complimentary to said outer shoulder on said inner mandrel whereby fluid pressure exerted between said shoulders by way of said lateral fluid passage and said axial fluid flow passageway of said inner mandrel urges said piston member in a direction away from said fishing nose on said latching mandrel;

first spring means disposed between said inner mandrel and said piston member for urging said piston member in a direction towards said fishing nose, a portion of said piston member covering said first spring means;

latching means disposed on said latching mandrel and connected to said piston member for latching said pulling tool to said fishing neck of said well tool when said fishing neck is engaged by said fishing nose; and releasing means for unlatching said pulling tool from said fishing neck of said well tool when sufficient fluid pressure is exerted between said inner mandrel outer shoulder and said piston member inner shoulder to overcome said first spring means and move said piston member away from said fishing nose.

2. The pulling tool of claim 1 wherein said latching means comprises at least one elongated latching member slidably positioned on said latching mandrel and extending in a direction parallel to the axis of said pulling tool, said latching member having an enlarged end portion sized to engage a corresponding enlarged end portion of said fishing neck.

3. The pulling tool of claim 2 wherein said latching means further comprises second spring means disposed between said piston member and said latching member for urging said enlarged end portion of said latching member to a first outward fishing neck engaging position, for allowing said enlarged end portion of said latching member to be moved by contact with said corresponding enlarged end portion of said fishing neck to a second inward non-engaging position as said fishing nose portion of said latching mandrel is moved into said fishing neck and for returning said enlarged end portion of said latching member to said first outward fishing neck engaging position whereby said pulling tool is latched to said fishing neck.

4. The pulling tool of claim 3 wherein said releasing means comprises:

said latching member including an outwardly extending shoulder on a portion thereof adjacent to said second spring means; and said piston member including a housing connected at the end thereof adjacent said latching mandrel, said housing covering said second spring means and said outwardly extending shoulder on said latching member and including an inwardly extending flange for engaging said outwardly extending shoulder whereby when said piston member moves in a direction away from said fishing nose of said latching mandrel, said housing and said latching member are also moved so that said enlarged end portion of said latching member is moved to said second inward non-engaging position.

5. The pulling tool of claim 1 wherein said piston member includes at least one lateral fluid drain port extending through a side of said piston member adjacent to said inner shoulder thereof for draining fluid from between said inner mandrel and said piston member.

6. The pulling tool of claim 1 wherein said crossover is threadedly connected to said inner mandrel.

7. The pulling tool of claim 1 wherein said latching means includes four latching members.

8. The pulling tool of claim 1 wherein said latching mandrel includes four fluid jet forming passages extending from said fluid flow passageway through said fishing nose.

9. The pulling tool of claim 1 wherein said elongated inner mandrel and said latching mandrel are threadedly connected together.

10. The pulling tool of claim 4 wherein said piston member and said housing are threadedly connected together.

11. The pulling tool of claim 1 wherein said latching mandrel includes a portion of reduced diameter and a portion of increased diameter whereby when said enlarged end portion of said latching member is in said first outward fishing neck engaging position it is adjacent said increased diameter portion of said latching mandrel and when said enlarged end portion of said latching member is in said second inward non-engaging position it is adjacent said reduced diameter portion of said latching mandrel.

12. The pulling tool of claim 3 further comprising a housing substantially enclosing said latching member and said second spring means.

13. The pulling tool of claim 12 wherein said piston member and said housing are threadedly connected together.

14. The pulling tool of claim 1 wherein said space is unsealed such that some fluid may leak therefrom as said fluid pressure is exerted.

15. An improved coiled tubing pulling tool for latching to a well tool having a fishing neck thereon comprising:

an elongated inner mandrel having an axial fluid flow passageway therethrough, said inner mandrel being adapted to be connected to a length of coiled tubing, said inner mandrel including an outer shoulder formed thereon and having a lateral fluid passageway extending from said axial fluid flow passageway to said outer shoulder;

a latching mandrel connected at the end of said inner mandrel opposite from said coiled tubing having a fluid flow passageway communicating with said fluid flow passageway of said inner mandrel, having a fishing nose thereon sized to engage said fishing neck on said well tool;

a tubular piston member slidably extending over said inner mandrel having an inner shoulder formed therein which is complimentary to said outer shoulder on said inner mandrel such that an unsealed space is defined therebetween whereby fluid pressure exerted in said space between said shoulders by way of said lateral fluid passage and said axial fluid flow passageway of said inner mandrel urges said piston member in a direction away from said fishing nose on said latching mandrel;

spring means disposed between said inner mandrel and said piston member for urging said piston member in a direction toward said fishing nose;

latching means disposed on said latching mandrel and connected to said piston member for latching said pulling tool to said fishing neck of said well tool when said fishing neck is engaged by said fishing nose; and releasing means for unlatching said pulling tool from said fishing neck of said well tool when sufficient fluid pressure is applied to said space between said inner mandrel outer shoulder and said piston member inner shoulder to overcome said spring means and move said piston member away from said fishing nose.

16. The pulling tool of claim 15 wherein said latching means comprises a separate elongated latching member slidably positioned on said latching mandrel and spaced from said piston member, said latching member extending in a direction parallel to the axis of said pulling tool and having an enlarged end portion sized to engage a corresponding enlarged end portion of said fishing neck.

17. The pulling tool of claim 16 wherein:

said spring means is a first spring means; and said latching means further comprises second spring means disposed between said piston member and said latching member, and covered by said piston member, for urging said enlarged end portion of said latching member to a first outward fishing neck engaging position, for allowing said enlarged end portion of said latching member to be moved by contact with said corresponding enlarged end portion of said fishing neck to a second inward non-engaging position as said fishing nose portion of said latching mandrel is moved into said fishing neck and for returning said enlarged end portion of said latching member to said first outward fishing neck engaging position whereby said pulling tool is latched to said fishing neck.

18. The pulling tool of claim 17 wherein said releasing means comprises:

said latching member including an outwardly extending shoulder on a portion thereof adjacent to said second spring means; and said piston member including a housing connected at the end thereof adjacent to said latching mandrel, said housing covering said second spring means and said outwardly extending shoulder on said latching member and including an inwardly extending flange for engaging said outwardly extending shoulder whereby when said piston member moves in a direction away from said fishing nose of said latching mandrel, said housing and said latching member are also moved so that said enlarged end portion of said latching member is moved to said second inward non-engaging position.

19. The pulling tool of claim 15 wherein said piston member includes at least one lateral fluid drain sport extending through a side of said piston member adjacent to said inner shoulder thereof for draining fluid from said space between said inner mandrel and said piston member.

20. The pulling tool of claim 15 wherein said latching mandrel includes a portion of reduced diameter and a portion of increased diameter whereby when said enlarged end portion of said latching member is in said first outward fishing neck engaging position it is adjacent to said increased diameter portion of said latching mandrel and when said enlarged end portion of said latching member is in said second inward non-engaging position it is adjacent to said reduced diameter portion of said latching mandrel.

* * * * *